United States Patent [19]

Biermann et al.

[11] 4,191,396

[45] Mar. 4, 1980

[54] CROSS COUNTRY SKI BINDING

[75] Inventors: Peter Biermann, Warmbronn; Otto Ewald, Griesheim, both of Fed. Rep. of Germany

[73] Assignee: Vereinigte Baubeschlagfabriken Gretsch and Company GmbH, Fed. Rep. of Germany

[21] Appl. No.: 849,447

[22] Filed: Nov. 7, 1977

[30] Foreign Application Priority Data

Nov. 5, 1976 [DE] Fed. Rep. of Germany ..... 2650678

[51] Int. Cl.[2] ..... A63C 9/00

[52] U.S. Cl. ..... 280/615; 280/618

[58] Field of Search ..... 280/615, 614, 635, 618, 280/617, 619, 611, 613

[56] References Cited

U.S. PATENT DOCUMENTS

| | | | |
|---|---|---|---|
| 1,565,106 | 12/1925 | Reach | 280/618 |

FOREIGN PATENT DOCUMENTS

| | | | |
|---|---|---|---|
| 2333042 | 4/1974 | Fed. Rep. of Germany | 280/615 |
| 2610041 | 10/1976 | Fed. Rep. of Germany | 280/615 |
| 772393 | 10/1934 | France | 280/615 |
| 109756 | 2/1944 | Sweden | 280/615 |
| 113817 | 4/1945 | Sweden | 280/615 |
| 201026 | 1/1939 | Switzerland | 280/611 |

*Primary Examiner*—Joseph F. Peters, Jr.
*Assistant Examiner*—Milton L. Smith
*Attorney, Agent, or Firm*—Craig and Antonelli

[57] ABSTRACT

A cross country ski binding includes a support element which has a rear part clampingly engageable with a forward extension of a ski boot sole and a front part which is fixedly attachable to a ski. In order to accommodate angular movement between the front and rear parts, a connecting part is provided which permits such angular movement about a cross axis extending crosswise of the longitudinal extent of the ski when the binding is in an in-use position. The cross axis may be formed by hinge pin connections between the front and rear parts or by portions of a leaf spring or a multiplicity of leaf springs interconnecting the front and rear parts. Resilient members such as springs, rubber cushions, and the like, are interposed between the front and rear parts to continuously resiliently bias the same in the direction corresponding to a flat position of the ski boot on the ski.

29 Claims, 16 Drawing Figures

FIG. 12
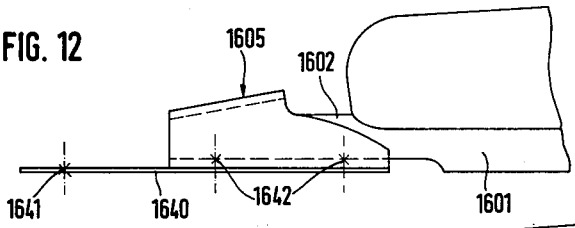
FIG. 13
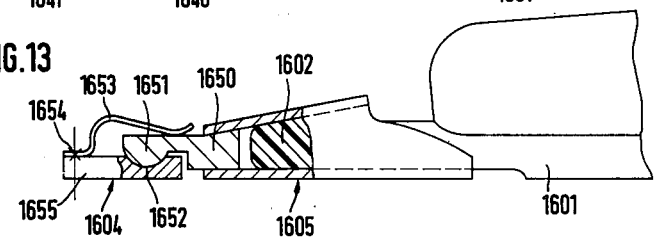
FIG. 14
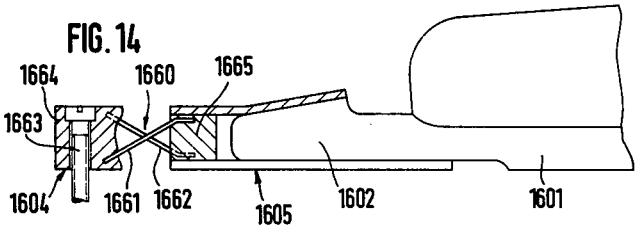
FIG. 15
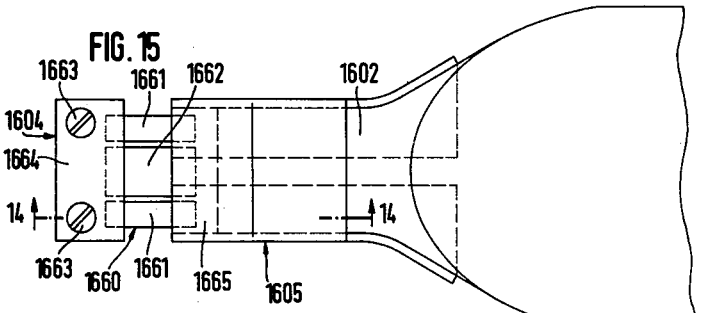
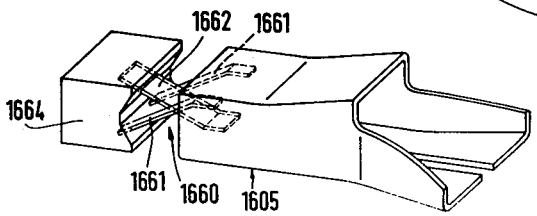
FIG. 16

CROSS COUNTRY SKI BINDING

BACKGROUND AND SUMMARY OF THE INVENTION

The present invention relates to cross country ski bindings of the type described in commonly assigned co-pending application Ser. No. 818,741, filed July 25, 1977. The subject matter of said application is incorporated herein by reference thereto, to the extent desired to facilitate an understanding of the present invention.

The noted copending application relates to a cross country binding with a forward supporting or bracing element for a shoe sole that engages the supporting element. A forward sole elongation engages the supporting element in such a manner that the sole can be lifted off the ski at its rear end whereby the sole elongation can be springingly locked to the ski automatically. Such a binding, with secure retention of the shoe, ensures a lifting off of the heel of the shoe from the ski which is necessary for cross country skiing, and non-fatiguing application of the ski [to the ground] even when there is a snow layer underneath, as well as stable and simple inexpensive construction, independent of the size of the shoe sole.

The present invention relates to the problem of ensuring a still better adaptation of the binding to the natural running motion of the foot, especially so that the skier will have a particularly unhindered lift of the heel from the ski.

Accordingly, the invention contemplates providing that a rear part of the supporting element which can clampingly accept the sole elongation is connected with a front part of the supporting element that is fixed on the ski, so as to be movable at an angle in the lifting-off direction of the shoe sole.

In particularly preferred embodiments, the arrangement is such that the axis of rotation for the angular movement of the rear part of the bracing element, running crosswise to the long axis of the ski, is disposed ahead of the sole elongation or at least in the forward zone thereof. The axis of rotation is determined by a hinge pin, or as an ideal axis of rotation with corresponding elastic deformation of the supporting element or of parts thereof according to various preferred embodiments of the invention.

The invention has the effect that the sole elongation is not itself rigidly connected with the ski. For this reason, the heel of the shoe can lift off freely from the ski in fast skiing, without being hindered by rigid clamping of the toe part of the shoe in the supporting element, and without causing fatigue over the long run.

In a special preferred embodiment of the invention, the lifting off of the rear part of the supporting element which can be lifted from the ski with angular movement occurs against a spring action that urges this part back toward the ski. The skier will thereby receive the necessary secure feeling of connection with the ski. On the other hand, the part that is lifted off with angular motion will return to the ski as soon as it is relieved of the load of the skier's shoe, and thus be ready for the ski to be set down again [on the ground surface].

Mobility between the part that receives the shoe sole elongation with angular mobility and the part of the supporting element that is fixed to the ski can be made either articulated or elastic by the springing elements in accordance with preferred embodiments of the invention. Preferred embodiments provide that the rear part that is angularly movable is connected with the front part that is fixed to the ski by means of torsion springs. Other preferred embodiments provide that the angularly-movable part bears against the part fixed to the ski, or directly against the ski, by means of an elastic element and a lever arm cooperating with it.

The use of rubber pads is particularly advantageous according to still other contemplated embodiments, said pads being torsion or pressure stressed, for example, and also rubber-metal parts where the rubber is vulcanized onto the metal. Use of metallic parts that slide on each other may thereby be reduced to a minimum.

An especially simple and inexpensive embodiment of the invention consists in use of wire springs that suitably are braced on the part fixed to the ski, and load the angularly-movable part which serves to accept the shoe sole elongation in a direction that presses against the ski.

These and other objects, features and advantages of the present invention will become more apparent from the following description when taken in connection with the accompanying drawings, which show, for purposes of illustration only, several embodiments in accordance with the present invention.

BRIEF DESCRIPTION OF THE DRAWINGS

FIG. 12 is a side view of a sixth embodiment of the invention;

FIG. 13 is a side view of a seventh embodiment of the invention, partly in section;

FIG. 14 is a side view of an eighth embodiment of the invention, partly in section, along line 14—14 of FIG. 15;

FIG. 15 is a top view of FIG. 14, and

FIG. 16 is a perspective of the embodiment according to FIGS. 14 and 15.

DETAILED DESCRIPTION OF THE DRAWINGS

Figure 1:
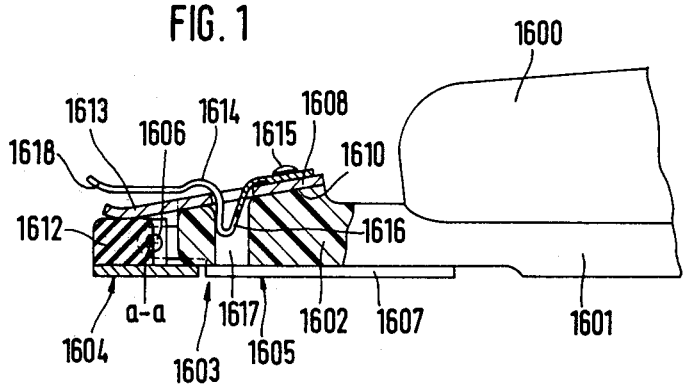
FIG. 1 is a side view of a first embodiment of the invention in partial cross section along line 1—1 of FIG. 2.

In all of the illustrated embodiments, shoe 1600 with a shoe sole 1601 presents a shoe sole elongation 1602 which is intended to be clamped by a forward supporting or bracing element 1603, to a ski which is not illustrated.

Supporting element 1603 comprises essentially a forward part 1604 fixed to the ski e.g. by screws, and a rear part 1605 which serves to accept shoe sole elongation 1602, said part 1605 being movable in a lifting-off direction with respect to an upper surface of a ski. In the embodiment according to FIGS. 1-3, both parts 1604 and 1605 are connected to each other on an axis of rotation a—a that runs parallel to the ski and crosswise to its long direction by two lateral hinge pins 1606. Part 1605 which is angularly movable is essentially box-shaped, with a base plate 1607 normally applied to the ski, an upper cover plate 1608 which is inclined forward at a slant in a wedge configuration, and side walls 1609 which walls widen out toward the back, like a hopper. The shoe sole elongation 1602 therefore can be shoved in from the back into part 1605 which is angularly movable, whereby upper surface 1610 of shoe sole elongation 1602 is applied with a wedging effect on cover plate 1608 from below and from the rear. Side walls 1609 are extended forward like a fork, with arms 1611 that serve to receive articulating pins 1606 to effect a connection with part 1604 that is fixed to the ski. The part fixed to the ski is essentially U-shaped in cross section, and made with a base plate that constitutes the crosspiece of the U, and side walls that constitute the arms, which arms are connected by hinge pins 1606 on the transverse axis a—a with arms 1611 of part 1605 that is angularly movable.

A rubber pad 1612 is set into the U-shaped part 1604 that is fixed to the ski, on which pad a lug-like lever arm 1613 that forms an extension of coverplate 1608 bears from above. Advantageously this arm 1613 is curved so that when the shoe sole and angularly movable part 1605 therewith is lifted, arm 1613 can roll down on rubber pad 1612 without damaging the pad.

For clamping shoe sole elongation 1602 in angularly movable part 1605, a leaf spring 1614 is provided as a clamping element, which is fixed by rivets 1615 on cover plate 1608, and engages by means of a bent down portion 1616 in a recess or break 1617 in the shoe sole elongation. The forward end 1618 is made as a grip so that by lifting the leaf spring end, bent down portion 1616 can be pulled upward from recess 1617, to release the shoe sole and elongation 1602 from engagement with the bracing element and its angularly movable part 1605 respectively.

To apply the binding, shoe sole elongation 1602 is shoved in from the rear, into angularly movable part 1605, whereby the forward end of the sole elongation will bend up the bent down portion 1616 in such a way that it will slide over the forward part of upper surface 1610 of the sole elongation and be able to snap into recess 1617 which serves as a counter clamp.

If during cross country skiing, the heel of the shoe is lifted from the ski, angularly movable part 1605 can turn about axis a—a of its articulation 1606 and thereby facilitate the lifting of the heel and sole from the ski.

Advantageously a stop is provided which limits the lift motion of angularly movable part 1605. Elastic pad 1612 suffices for this limitation: this member (pad) 1612 also exerting a springing return effect on the angularly movable part so that with release by the shoe it is returned to its original position on the ski.

Instead of leaf spring 1614, other clamping devices may be provided which can be incorporated in the binding. Especially, the clamping devices may be used, as described and illustrated in the above-noted copending application. This applies also to the embodiments of the invention which are to be described below, where a clamping element has been left out of the drawing for the sake of clarity, it being understood that each of these embodiments will also include means for clamping the shoe sole elongation to the rear angularly movable support element part.

Figure 4:
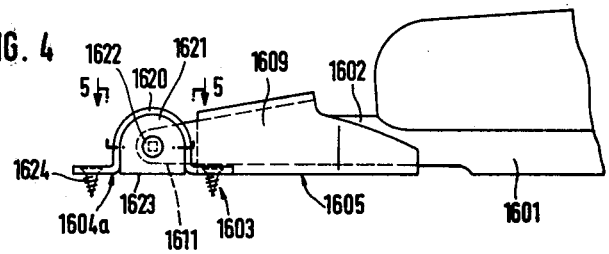
FIG. 4 is a side view of a second embodiment of the invention.
Figure 5:
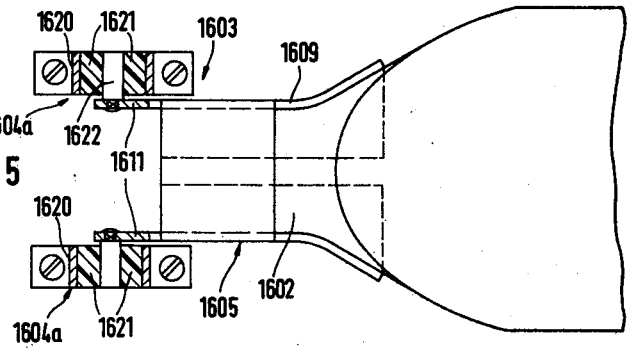
FIG. 5 is a top view of FIG. 4 in partial cross section along line 5—5 of FIG. 4.

The embodiment of FIGS. 4 and 5 is distinguished from the previous example in that the front part of support element 1603 which is fixed to the ski comprises two shell-like U-shaped parts 1620 fixed to the ski by screws 1624, in which annular elastic buffers 1621 made of rubber or a similar material have been set in. Buffers 1621 are respectively joined to the associated bearing part 1620 on their peripheral surface by vulcanization therewith, and to a pin 1622 on their inner surface, by vulcanizing, said pins 1622 being in turn anchored, secured against rotation in one of the fork arms 1611 of angularly movable part 1605—directed outward from the fork arm. Advantageously, elastic buffer 1621 is flattened on its under side 1623 so that it cannot turn with reference to the ski.

If shoe sole 1601 is lifted together with angularly movable part 1605, the latter turns about the axis of pin 1622. Because elastic buffer 1621 is vulcanized to hinge pin 1622 to the one hand and to support element parts 1620 on the other, the rubber of elastic buffer 1621 will be torsion stressed and therefore have the effect that lifting can only occur against the restoring action of the buffer.

Figure 6:
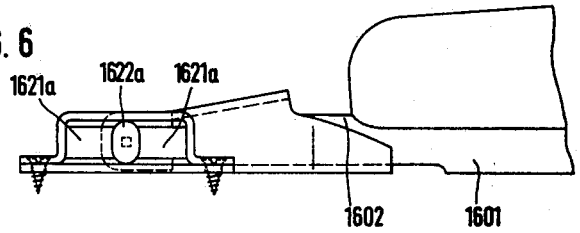
FIG. 6 is a side view of a third embodiment of the invention.
Figure 7:
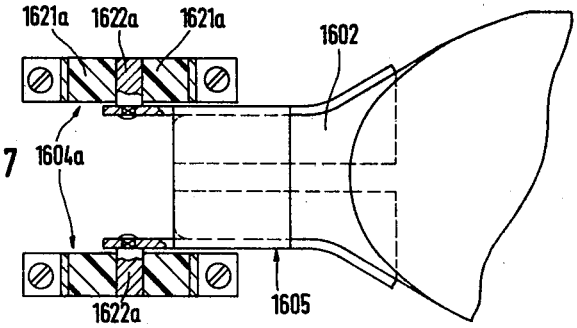
FIG. 7 is a top view of FIG. 6 in partial cross section corresponding to that of FIG. 5.

The embodiment of FIGS. 6 and 7 is distinguished from that of FIGS. 4 and 5 in that bearing pins **1622*a* are made like a toggle with a somewhat elliptical cross section and bear on two separate elastic buffers 1621*a*. When shoe heel 1601 and sole elongation 1602 are lifted, elastic buffers 1621*a* will be respectively pressure deformed, whereby they also will exert a restoring action on shoe sole 1601**.

Otherwise what has been said of the embodiment according to FIGS. 4 and 5 applies to that of FIGS. 6 and 7.

Figure 8:
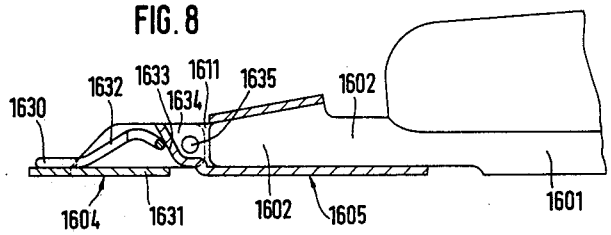
FIG. 8 is a side view of a fourth embodiment of the invention in partial cross section along line 8—8 of FIG. 9.
Figure 9:
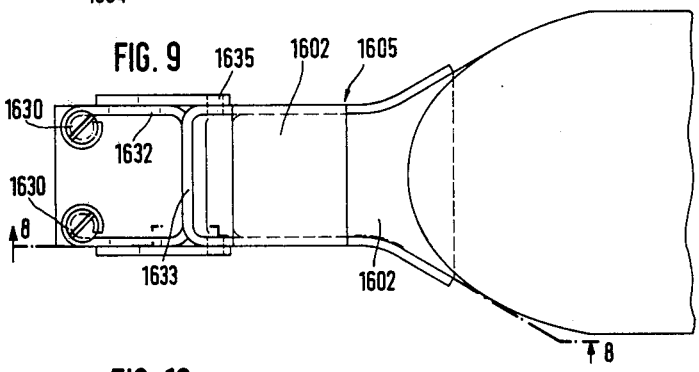
FIG. 9 is a top view of FIG. 8.
Figure 10:
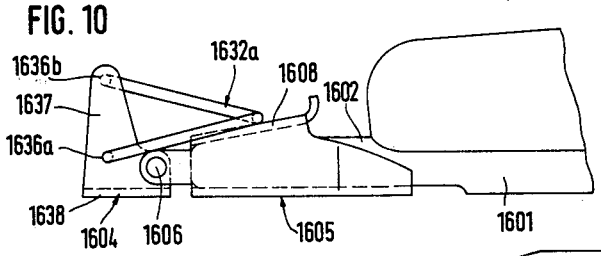
FIG. 10 is a side view of a fifth embodiment of the invention.
Figure 11:
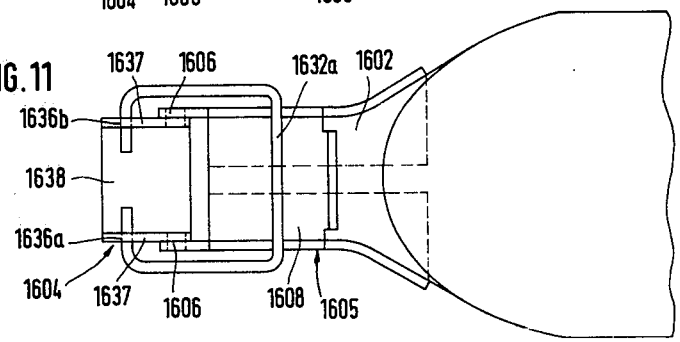
FIG. 11 is a top view of FIG. 10.

In the embodiments according to FIGS. 8 and 9 on the one hand and FIGS. 10 and 11 on the other, wire springs are used as elastic restoring elements. For this, in the embodiment of FIGS. 8 and 9, an arcuate wire spring 1632 is fixed to the base plate 1631 that is connected to the ski. Said spring 1632 bears from below against a wall 1633 that is directed slantingly forward and upward. Wall 1633 is part of a stop 1634 disposed ahead of hinge pin 1635 and constitutes a lever arm of angularly movable part 1605. By the upwardly directed force of arcuate wire spring 1632, shoe sole 1601 is pressed against the ski. When the shoe sole is lifted, angularly movable part 1605 can turn about hinge pin 1635, and thereby tension or supplementarily tension wire spring 1632, by means of slanting wall 1633.

Figure 2:
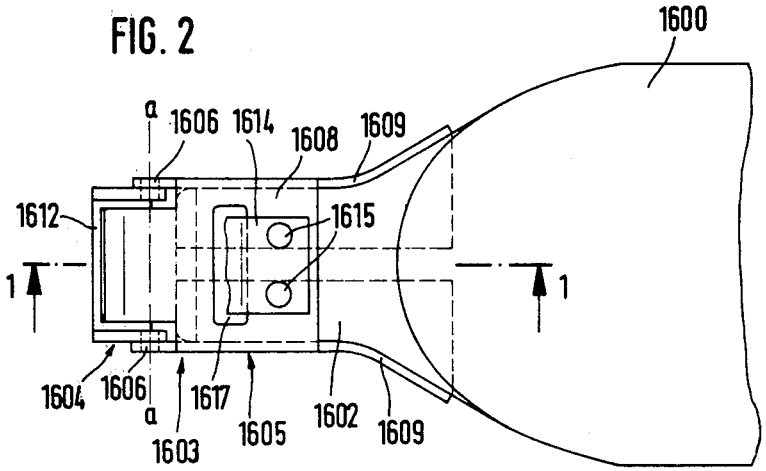
FIG. 2 is a top view of the embodiment of FIG. 1 with a partly cut away clamping element.
Figure 3:
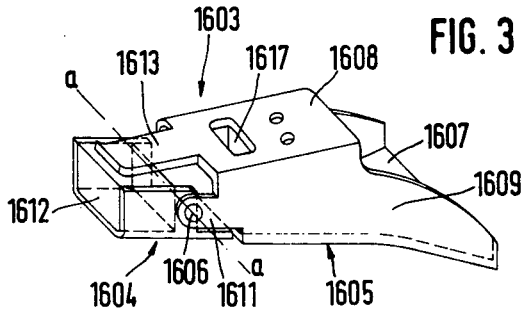
FIG. 3 is a perspective of the embodiment of FIGS. 1 and 2, without the clamping element.

In the embodiment according to FIGS. 10 and 11, wire spring **1632*a* which is arcuate in top view has a V configuration when seen from the side. One arm of spring 1623*a* is anchored in a lower hole 1636*a* and the other arm is anchored in an upper hole 1636*b* in upwardly directed arms 1637 of a bearing block 1638 which has a U shape in frontal view, by lateral springing insertion [into the holes]. The middle part of wire spring 1632*a* in this case presses from above on upper cover wall 1608 of angularly movable part 1605, which according to the embodiment of FIGS. 1 to 3 is articulatedly connected by lateral pins 1606 to the lateral bearing blocks 1637 of part 1604** that is fixed to the ski.

When shoe sole 1601 and therewith sole elongation 1602 is lifted, angularly movable part 1605 can again lift along with it, about axis of rotation a—a determined by pin 1606, against the return action of wire spring 1632*a*, since the spring will be tensioned or supplementary tensioned.

In the embodiment according to FIG. 12, angularly movable part 1605 of the bracing element that serves to accept shoe sole elongation 1602 is connected to the ski by a leaf spring 1640 that at the same time constitutes the part that is fixed to the ski. The leaf spring 1640 is fixedly clamped to the ski, at 1641 by screws, and at 1642 it is fixedly connected to the sole plate of angularly movable part 1605, so that when the shoe sole 1601 is lifted, angularly movable part 1605 with the shoe sole elongation 1602 can lift along with it about an ideal axis of rotation disposed about in the middle part of left spring 1640, by upward bending against the elastic action of left spring 1640.

In the embodiment according to FIG. 13, angularly moving part 1605 which accepts shoe sole elongation 1602 presents a piece 1650 that is fixedly connected, e.g. welded to it, forming a forward curvedly bulged projection 1651 that engages in a bowl shaped depression 1652 in part 1604 that is fixed to the ski. A leaf spring 1653, fixedly joined at 1654 for example to the base plate 1655 of part 1604 that is fixed to the ski, engages with its S-shaped bent rear part over projection 1651 and presses it firmly into bowl shaped depression 1652. When shoe sole 1601 and therewith shoe sole elongation 1602 if lifted, projection 1651 can turn in bowl shaped depression 1652, whereby leaf spring 1653, as an elastic element, tends to force the rear angularly movable part 1605 back into its position of application on the ski.

The embodiment according to FIGS. 14 to 16 shows a connection of the angularly movable part 1605 to the part 1604 that is fixed to the ski by means of a crossed spring articulation 1660, which consists substantially of two spring elements or groups of spring elements 1661 and 1662 that act like leaf springs, intersecting each other and being respectively anchored at one end in a block 1664 of part 1604 that is fixed to the ski, said block 1664 being fixed to the ski by screws 1663, and respectively anchored at the other end in a block 1665 of angularly movable part 1605.

When shoe sole 1601 and shoe sole elongation 1602 are lifted, the leaf spring-like spring elements 1661 and 1662 are deformed because the shoe sole turns somewhat about a transverse axis lying in the region of crossed spring articulation 1660.

The invention is not restricted to the illustrated embodiments. As already noted, the clamping device in all cases may correspond to that of FIGS. 1 and 2, or it may be made in some other way. Axis of rotation a—a in all cases may lie in a region ahead of the shoe sole elongation or in the region of the shoe sole elongation, running crosswise to the long axis of the ski.

While we have shown and described only several embodiments in accordance with the present invention, it is understood that the same is not limited thereto but is susceptible of numerous changes and modifications as would be known to those skilled in the art, given the present disclosure, we therefore do not wish to be limited to the details shown and described herein but intend to cover all such changes and modifications as are encompassed by the scope of the appended claims.

We claim:

1. Cross country ski binding comprising:

forward ski boot support element means fixedly attachable to a ski, said support element means including means supportingly engageable with a forward sole extension of a ski boot while permitting lifting of the rear part of said ski boot from the ski, and resiliently biased latching means for engaging said support element means with said forward sole extension to latch said sole extension to said ski, wherein said support element means includes a front support element part which is fixedly attachable to said ski, a rear support element part engageable with a free end of said forward sole extension, in a manner which leaves a longitudinal portion of the sole extension between said free end and a show portion of the ski boot unrestrained against lift-off from said rear support element part, and a connecting part connecting said front and rear support element parts for angular movement relative to one another, whereby ease of lifting the rear part of said ski boot is enhanced by said angular movement.

2. Cross country ski binding according to claim 1, wherein said connecting part is configured for accommodating said angular movement about a cross axis extending cross-wise to the length of the ski when it is in an in-use position on the ski, and wherein said cross axis is disposed forwardly of at least a substantial portion of the forward sole extension.

3. Cross country ski binding according to claim 1, wherein said connecting part pivotally articulatedly connects said rear part to said front part.

4. Cross country ski binding according to claim 3, wherein said rear part bears on the front part by means of a curvedly bulged part that engages in a bowl-shaped depression, and wherein said bulged part and bowl-shaped depression are urged toward one another by resilient means.

5. Cross country ski binding according to claim 1, wherein resilient return means are interposed between said front and rear parts for applying resilient forces in a direction corresponding to said ski boot having its rear part on said ski.

6. Cross country ski binding according to claim 5, wherein said resilient return means is a torsion spring.

7. Cross country ski binding according to claim 6, wherein said torsion spring is made as a rubber-metal spring.

8. Cross country ski binding according to claim 7, wherein the rubber metal spring comprises a rubber ring connected by vulcanizing to an inner hinge pin and an outer bearing bush.

9. Cross country ski binding acoording to claim 5, wherein said resilient return means is a wire spring.

10. Cross country ski binding according to claim 9, wherein said wire spring is carried on said front part, and wherein said rear part includes a forward extension which bears from above on said wire spring.

11. Cross country ski binding according to claim 9, wherein said rear part is loaded from above by said wire spring, which wire spring is fixed on said front part.

12. Cross country ski binding according to claim 1, wherein said connecting part is formed as a portion of a leaf spring which also forms said front part.

13. Cross country ski binding according to claim 1, wherein said connecting part includes leaf spring means attached to each of said front and rear parts.

14. Cross country ski binding according to claim 1, wherein stop means are provided for limiting the angular movability of said rear part relative to said forward part.

15. Cross country ski binding according to claim 14, wherein said stop means includes resilient return means separate from said connecting part.

16. Cross country ski binding according to claim 15, wherein said resilient return means is an elastic buffer.

17. Cross country ski binding to claim 16, wherein said elastic buffer is made as a rubber buffer.

18. Cross country ski binding according to claim 16, wherein said elastic buffer is made as a metallic spring.

19. Cross country ski binding according to claim 15, wherein said connecting part is configured for accommodating said angular movement about a cross axis extending cross-wise to the length of the ski when it is in an in-use position on the ski, and wherein said cross axis is disposed forwardly of at least a substantial portion of the forward sole extension.

20. Cross country ski binding according to claim 19, wherein said rear part includes an abutment portion extending forwardly of said cross axis, and wherein said resilient return means is connected with said forward part and is disposed to be engaged by said abutment portion during angular movement of said rear part.

21. Cross country ski binding according to claim 20, wherein said resilient stop means is an elastic buffer member.

22. Cross country ski binding according to claim 21, wherein said front part is U-shaped and exhibits vertically extending walls which engage said elastic buffer member on back and sides thereof, and wherein said rear part is articulated by means of forklike bearing arms to said vertically extending walls.

23. Cross country ski binding according to claim 15, wherein said resilient return means is a wire spring.

24. Cross country ski binding according to claim 14, wherein said stop means includes said connecting part, said connecting part being configured to resiliently oppose said angular movement.

25. Cross country ski binding according to claim 1, wherein said rear part is connected directly to said ski by a leaf spring, forward portion of said leaf spring forming said front part.

26. Cross country ski binding comprising:

forward ski boot support element means fixedly attachable to a ski, said support element means including means supportingly engageable with a forward sole extension of a ski boot while permitting lifting of the rear part of said ski boot from the ski, and resiliently biased latching means for engaging said support element means with said forward sole extension to latch said sole extension to said ski, wherein said support element means includes a front support element part which is fixedly attachable to said ski, a rear support element part engageable with said forward sole extension, and a connecting part connecting said front and rear support element parts for angular movement relative to one another, whereby ease of lifting of the rear part of said ski boot is enhanced by said angular movement, wherein resilient return means are interposed between said front and rear parts for applying resilient forces in a direction corresponding to said ski boot having its rear part on said ski, and wherein said connecting part includes a toggle-like pin which is tensioned between elastic buffers which form said resilient return means.

27. Cross country ski binding comprising:

forward ski boot support element fixedly attachable to a ski, said support element means including means supportingly engageable with a forward sole extension of a ski boot while permitting lifting of the rear part of said ski boot from the ski, and resiliently biased latching means for engaging said support element means with said forward sole extension to latch said sole extension to said ski, wherein said support element means includes a front support element part which is fixedly attachable to said ski, a rear support element engageable with said forward sole extension, and a connecting part connecting said front and rear support element parts for angular movement relative to one another, whereby ease of lifting of the rear part of said ski boot is enhanced by said angular movement, wherein resilient return means are interposed between said front and rear parts for applying resilient forces in a direction corresponding to said ski boot having its rear part on said ski, wherein said resilient return means is a wire spring, wherein said rear part is loaded from above by said wire spring, which wire spring is fixed on said front part, and wherein said wire spring exhibits a U-shape in top view and a V-shape in side view, wherein said wire spring is anchored at its ends to said front part and bears by means of its middle part on said rear part.

28. Cross country ski binding comprising:

forward ski boot support element means fixedly attachable to a ski, said support element means including means supportingly engageable with a forward sole extension of a ski boot while permitting lifting of the rear part of said ski boot from the ski, and resiliently biased latching means for engaging said support element means with said forward sole extension to latch said sole extension to said ski, wherein said support element means includes a front support element part which is fixedly attachable to said ski, a rear support element part engageable with said forward sole extension, and a connecting part connecting said front and rear support element parts for angular movement relative to one another, whereby ease of lifting of the rear part of said ski boot is enhanced by said angular movement, wherein resilient return means are interposed between said front and rear parts for applying resilient forces in a direction corresponding to said ski boot having its rear part on said ski, and wherein said resilient return means includes a crossed spring articulation which also forms said connecting part.

29. Cross country ski binding comprising:

forward ski boot support element means fixedly attachable to a ski, said support element means including means supportingly engageable with a forward sole extension of a ski boot while permitting lifting of the rear part of said ski boot from the ski, and latching means for engaging said support element means with said forward sole extension to latch said sole extension to said ski, wherein said support element means includes a front support element part which is fixedly attachable to said ski, a rear support element part engageable with a free end of said forward sole extension in a manner which leaves a longitudinal portion of the frontal sole extension, between said free end and a shoe portion of the ski boot, unrestrained against lift-off from any front support element, and a connecting part connecting said front and rear support element parts for angular movement relative to one another, whereby ease of lifting of the rear part of said ski boot is enhanced by said angular movement.

* * * * *